United States Patent [19]

Kraus

[11] 4,235,269

[45] Nov. 25, 1980

[54] TURNING TOOL WITH TIP STORAGE AND RETRACTABLE LEVER

[76] Inventor: Hans Kraus, Covina, Calif.

[21] Appl. No.: 929,331

[22] Filed: Jul. 31, 1978

[51] Int. Cl.[3] ..... B25G 1/12

[52] U.S. Cl. ..... 81/438; 145/61 L; 145/62; 145/71; 81/177 M; 81/60

[58] Field of Search ..... 145/61 L, 62, 63, 50 DA, 145/50 C

[56] References Cited

U.S. PATENT DOCUMENTS

| | | | |
|---|---|---|---|
| 707,901 | 8/1902 | Cheney | 145/62 |
| 939,079 | 11/1909 | Peck | 145/62 |
| 1,079,912 | 11/1913 | Cutter | 145/61 L |
| 1,559,097 | 10/1925 | Hill | 145/61 L |
| 2,550,775 | 5/1951 | Clark | 145/50 DA |
| 2,778,396 | 1/1957 | Swain | 145/61 L |
| 2,838,082 | 6/1958 | Lange | 145/50 DA |
| 3,683,984 | 8/1972 | Hull | 145/62 |
| 3,863,693 | 2/1975 | Carriker | 145/61 L |

*Primary Examiner*—Othell M. Simpson
*Assistant Examiner*—J. T. Zatarga
*Attorney, Agent, or Firm*—Boniard I. Brown

[57] ABSTRACT

A screwdriver or like hand tool has interchangeable tips or bits storable in a groove or recess in a handle, and a foldable auxiliary lever for increased torque which is pivotable into another recess in the handle. The interchangeable tips or bits and the lever are magnetically releasibly retained in their recesses. Bits fit into and are magnetically retained in a socket at the end of a shaft rotatably mounted in the handle. The lever in its inwardly pivoted storage position keys the shaft to the handle. A reversible ratchet is provided. The tool may be a screwdriver or a tool for wrench sockets, screw extractors, or other types of bits or tips.

9 Claims, 7 Drawing Figures

TURNING TOOL WITH TIP STORAGE AND RETRACTABLE LEVER

BACKGROUND OF THE INVENTION

Many types of hand tools and screwdrivers have heretofore been devised, and such features thereof as interchangeable bits, ratchets, and pivotable levers are known in the art. Such prior tools have various shortcomings, including lack of ruggedness and strength, inconvenient and awkward configurations, overcomplication, and lack of convenient, reliable means for retaining spare tips and levers.

SUMMARY OF THE INVENTION

The turning tool, typically a screwdriver, has a shaft axially and rotatably mounted in a handle. Interchangeable tips or bits are visibly stored and retained in an axially extending recess or groove in the handle. A selected tip is releasibly retained in the tip retaining means magnetically. The tips are removable from their recess or groove by manual sliding thereof over the end of the magnet. The storage of the interchangeable tips in the axially-extending recess in the handle makes possible the extension of the shaft further into the handle, thus providing greater structural strength relative to applied turning loads, than prior devices which store tips or bits in a handle portion under an end cap.

An auxiliary lever, utilized to effect higher turning torque in service, is pivotally mounted to a housing adjacent to the handle. The lever in its retracted position is received in a second axially-extending groove in the handle and spaced from the tips-retaining recess, and is pivotable into a radially-extended service position.

A magnet, preferably a bar magnet, extends diametrically through the handle, one end portion of the magnet being positioned to retain a tip positioned adjacent an open end of the tip-retaining recess, thus retaining the other tips in the recess by means of the magnetically retained tip. The other end portion of the magnet is positioned to releasibly magnetically retain the lever in its retracted position in its recess. Although separate magnet means may be utilized for the tips and for the lever, it is quite advantageous and preferred that a single magnet be utilized, in accordance with the invention. In its retracted position, the lever keys the ratchet housing to the handle, and when the lever is in its extended service position, the shaft is free to rotate relative to the handle.

The ratchet housing embodies the pawl portion of a conventional ratchet mechanism the ratchet piece or grooves preferably being formed as radial grooves on the inside surface of a ferrule secured for rotation with the shaft. The ratchet, of course, may be set in locked position for operation as a simple, conventional screwdriver without ratchet operation.

With the lever in its extended position, greatly increased torque is applicable by manual force, thus to turn rusted, corroded, large or difficult screws, nuts, or fasteners, with much more effect than is possible with conventional hand tools.

DESCRIPTION OF THE PREFERRED EMBODIMENT

Figure 2:
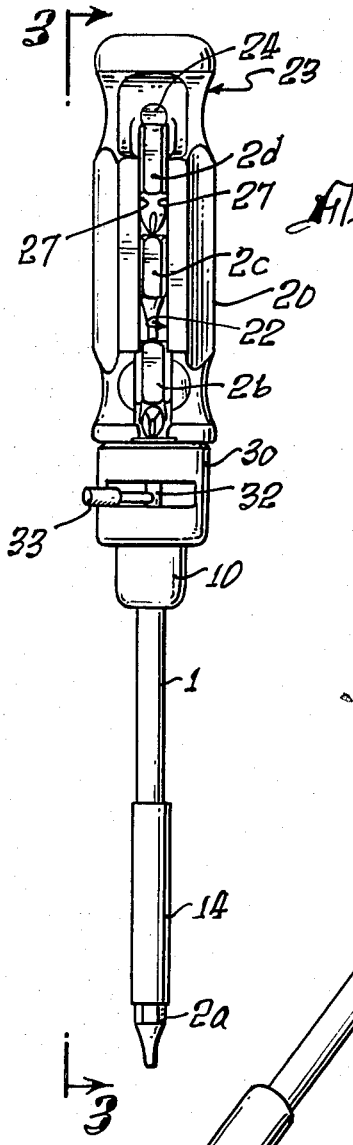
FIG. 2 is an elevational view showing the recess-storage of tips according to the invention.
Figure 1:
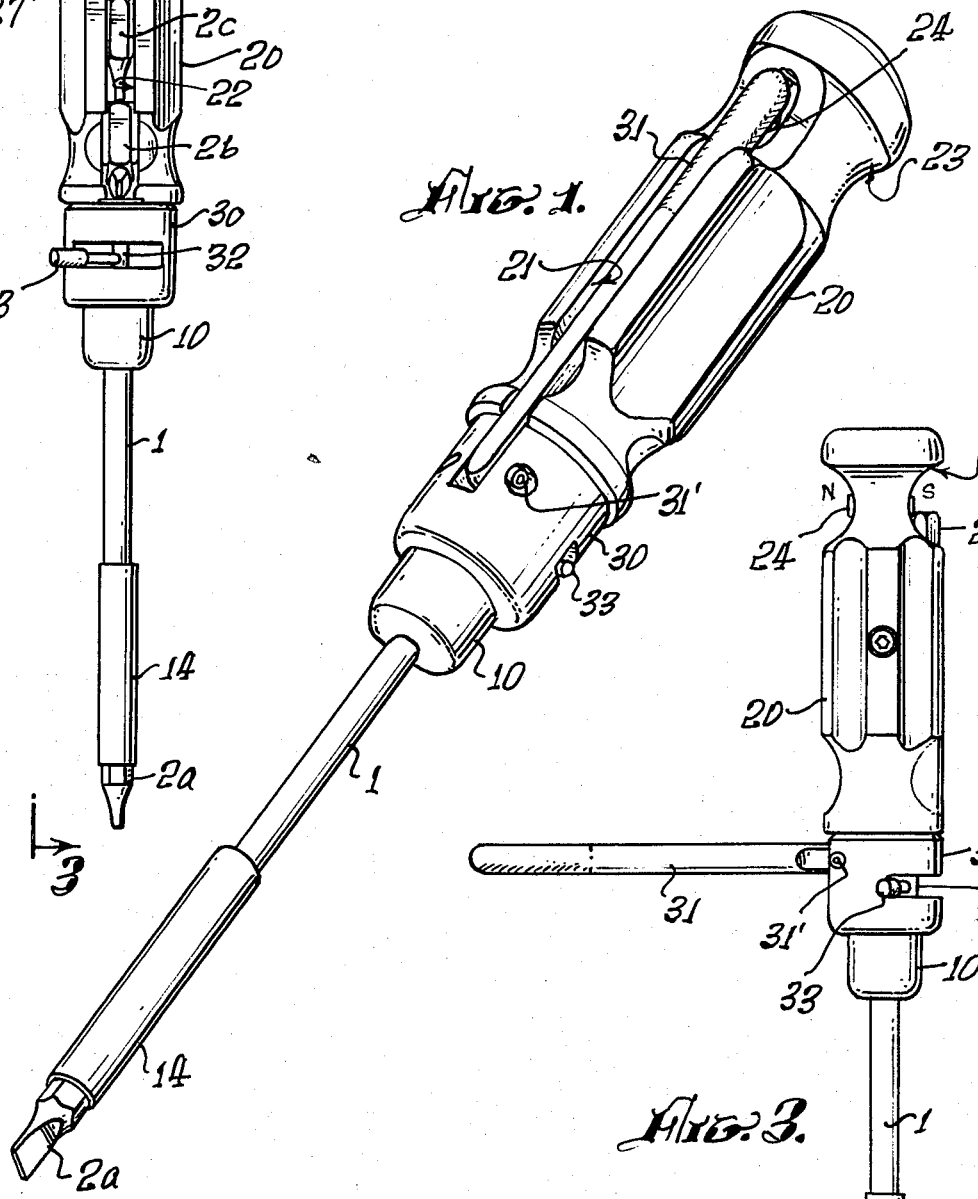
FIG. 1 is a perspective view of a turning tool according to the invention.
Figure 4:
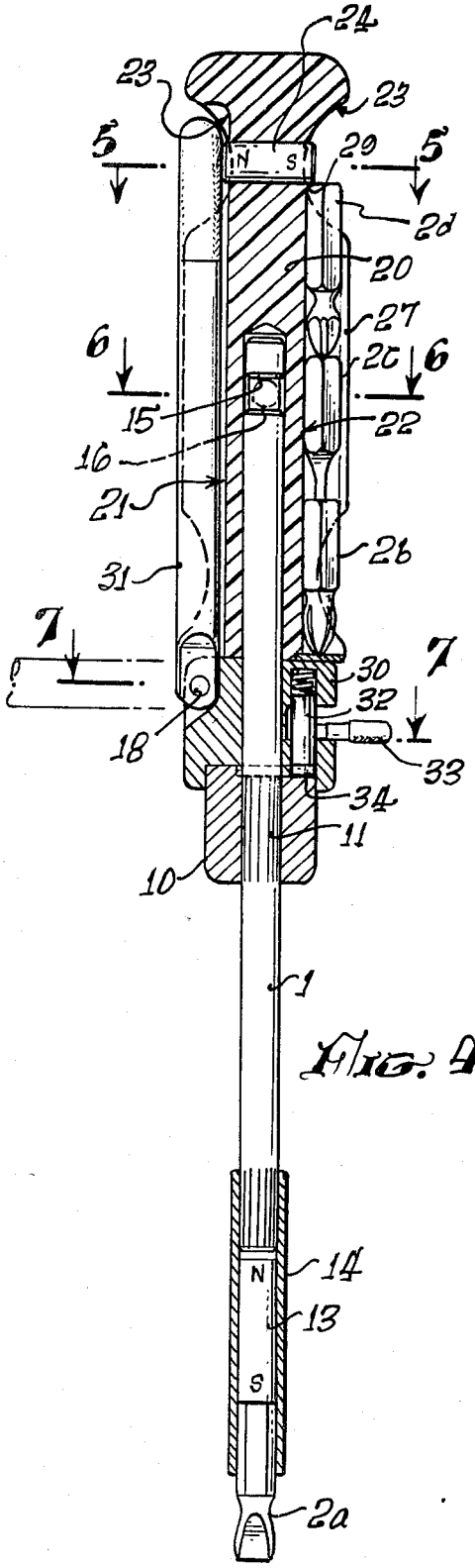
FIG. 4 is an enlarged sectional view of the turning tool of FIG. 1.

Referring to the drawings, and particularly to FIGS. 1, 2 and 4, a preferred form of the tool of the invention comprises a shaft 1 which is rotatably mounted in an axial bore of a handle 20, which may be fabricated of appropriate plastic material. A tip socket 14 at the outer end of shaft 1 preferably has a recess of polygonal or hexagonal configuration to which a bit *2a* is retained. A ferrule 10 is secured to shaft 1, as by being press-fitted on knurled portion 11 of the shaft (FIG. 4).

Figure 3:
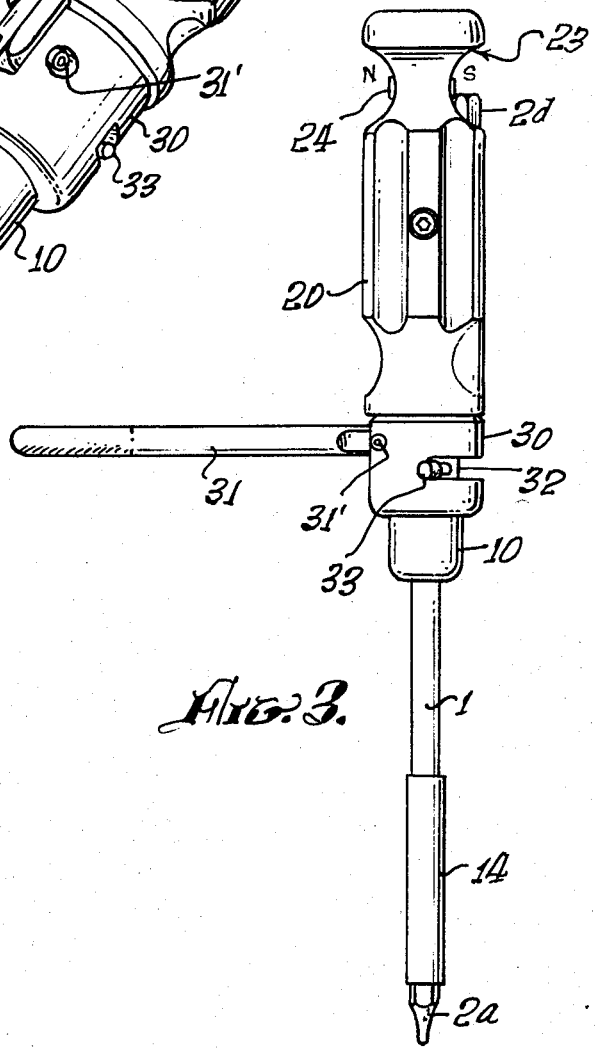
FIG. 3 is an elevational view taken at line 3—3 in FIG. 2, and showing a lever utilized with the invention in its extended position.

A lever 31 is pivotally mounted on the ratchet housing 30 at pivot pin 18 (FIG. 4), and is pivotable into its radially extended service position, shown in FIG. 3. In its retracted position, the lever is substantially within the recess 21, as shown, and its end portion opposite from the pivot is disposed for manual grasping, by the space provided by a reduced portion 23 of the handle. The lever being pivoted on the housing 30, serves to key the housing 30 and the handle 20 for rotation together when the lever is in its retracted position in the recess 21, without interfering with the grip of an operator on the handle.

Figure 5:
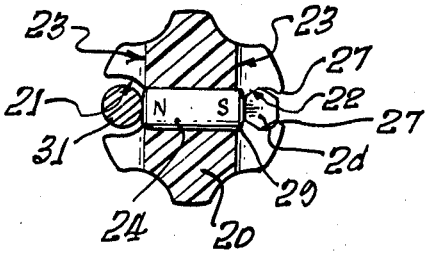
FIG. 5 is a sectional view taken at line 5—5 in FIG. 4.

As shown in FIG. 2, a second axially extending recess or groove 22 is defined in handle 20, opposite from the lever recess 21. A plurality of interchangeable spare tips or bits, such as *2b*, *2c*, *2d*, are received and storable in the groove, and the lips of the groove 22 extend inwardly at 27 to retain the tips. Groove 22 has an open end adjacent to the space provided by reduced handle portion 23, thus providing for the manual grasping of a tip which is positioned adjacent the open end of the groove, for removal of a tip, as well as for insertion of tips into the groove. A magnet 24, diametrically positioned in the handle, as shown in FIGS. 4 and 5, magnetically retains the tip which is positioned adjacent the open end of the groove 22, while the adjacent finger space defined by reduced portion 23 of the handle permits manual grasping of the tip and the sliding of the same across the end of the magnet for removal. An end portion 29 of the magnet 24 may preferably protrude slightly, as indicated in FIG. 4, so that the end of a tip, such as tip *2d* is thereby retained to a degree, while still being readily removable by manual grasping.

Figure 6:
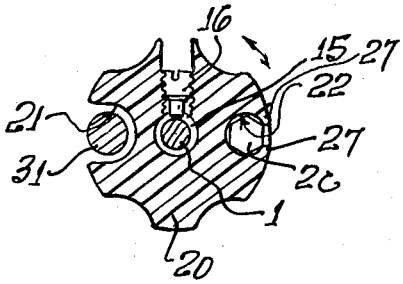
FIG. 6 is a sectional view taken at line 6—6 in FIG. 4.
Figure 7:
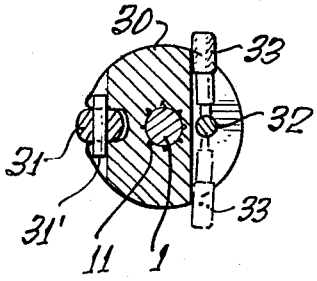
FIG. 7 is a sectional view taken at line 7—7 in FIG. 4.

Shaft 1 is axially retained relative to the handle by means of a set screw 16 mounted in a threaded opening in the handle and received in an annular groove 15 in the shaft 1, as shown in FIGS. 6 and 4.

The end portion of magnet 24 opposite from the tip-retaining magnet portion, serves to magnetically retain the end portion of lever 31, thus to releasibly secure the lever in its recess.

Conventional reversible ratchet means are provided between ratchet housing 30 and ferrule 10. Although there is no necessity for detailed description of the ratchet means, which is quite conventional, it may be stated that such ratchet means include a pawl 32 slidable an opening in housing 30 and rotatable relative to the shaft 1, a manual reversing switch element 33, and ratchet teeth 34 on the upper face of ferrule 10.

As shown in FIG. 4, tip-holding means or socket sleeve 14 is secured to the lower end of shaft 1, and has a polygonal or hexagonal recess adapted to receive a correspondingly shaped portion of a tip, such as tip 2*a*. The sleeve 14 is preferably fabricated of a high-strength non-magnetic material, such as hard anodized aluminum alloy. A small magnet 13, being the second magnet utilized with the tool, is mounted within sleeve 14 to magnetically releasibly secure the tip.

It will be appreciated that the single magnet 24 (FIGS. 4 and 5) serves both to retain the plurality of interchangeable tips in their recess or groove 22 wherein they are visible for selection, and to releasibly retain the lever 31 in its recess. This magnet also facilitates access to the tips not initially positioned adjacent the open end of the groove 22, in that once an end tip adjacent the open end is manually removed, the adjacent tip follows by magnetic attraction between the tips, placing the adjacent tip in position adjacent to the open end of the groove, in which position it is retained by the magnet.

The storage of the interchangeable tips or bits in the axially extending handle recess permits the utilization of a shorter handle and the extension of the shaft further into the handle, thus providing greater structural strength, than in conventional tools wherein a plurality of tips are stored in a recess or space in the end portion of the handle.

By way of example only, a tool according to the invention may be approximately 25 centimeters long, and the magnet 13 and 24 may each be approximately 6 millimeters in diameter and 15 millimeters long.

The inventor claims:

1. A turning tool comprising:

a handle rotatably mounted on a shaft having an axis, a housing rotatably mounted on the shaft, a ferrule coaxial with and secured to the shaft to rotate therewith, releasable means in the housing cooperable with the secured ferrule to drive the shaft, a first recess in the handle parallel to said axis and having an open end, a plurality of interchangeable tips storable in the first recess in end-to-end relation, handle magnet means protruding from the handle to partially overly said open end of the first recess and to contact and releasibly retain an end one of the tips adjacent the recess open end in position for manual grasping, tip retaining means at the end of the shaft for releasibly holding a selected one of said tips, a lever pivotally connected to the housing and pivotable between a retracted storage position and a radially extended service position, and a second recess in the handle radially spaced from and parallel to the first recess to receive the lever in its retracted storage position wherein the lever is substantially within the recess, said handle magnet means being positioned in the handle magnetically to engage and releasibly retain the lever in its retracted storage position.

2. A tool according to claim 1, wherein:

said handle magnet means extends diametrically of the handle with one end portion thereof releasibly retaining said lever and the other end portion thereof releasibly retaining said tip adjacent the first recess open end.

3. A tool according to claim 1 or claim 2, wherein:

the lever in its retracted storage position keys the housing to the handle, and in its radially extended service position releases the handle for rotation relative to the shaft.

4. A tool according to claim 1 or claim 2, wherein:

the respective tips have polygonal portions, and said bit retainer comprises a non-magnetic sleeve at the end of the shaft defining a bit-receiving recess of polygonal cross-section, and shaft magnet means adjacent the sleeve to releasibly retain a bit.

5. A tool according to claim 1 or claim 2, wherein:

said first recess is undercut with inwardly extending lips to retain said tips.

6. A tool according to claim 1 or claim 2, wherein:

the handle has a reduced portion defining a finger space adjacent said first recess open end to provide for manual grasping of said end one of the tips.

7. A tool according to claim 6, wherein:

said second recess has an open end from which an outer end portion of the lever extends when the lever is in said retracted storage position, and said finger space defined by the handle reduced portion is adjacent to the second recess open end to provide for manual grasping of the lever outer end portion.

8. A tool according to claim 1, wherein:

upon manual movement of said end one of the tips outward from the open end of the first recess said end one of said tips magnetically attracts the next adjacent tip to move the latter into the end position for manual grasping.

9. A tool according to claim 5, wherein:

upon manual movement of said end one of the tips outward from the open end of the first recess said end one of said tips magnetically attracts the next adjacent tip to move the latter into the end position for manual grasping.

* * * * *